US005624238A

United States Patent [19]

Herbert

[11] Patent Number: 5,624,238

[45] Date of Patent: Apr. 29, 1997

[54] PORTABLE WATER PUMP FOR USE WITH SWIMMING POOLS

[76] Inventor: Graham R. Herbert, 406 S. Cherrywood Ave., West Covina, Calif. 91791

[21] Appl. No.: 654,083

[22] Filed: May 28, 1996

[51] Int. Cl.[6] ..... F04B 49/00

[52] U.S. Cl. ..... 417/61; 417/234

[58] Field of Search ..... 417/61, 234, 364

[56] References Cited

U.S. PATENT DOCUMENTS 1,909,578 5/1933 Franke ..... 417/61
3,470,822 10/1969 Evans et al. ..... 417/234 X
3,612,721 10/1971 Evans et al. ..... 417/61
4,553,902 11/1985 Eberhardt ..... 417/61 X
5,419,497 5/1995 Warrington ..... 417/234 X

*Primary Examiner*—Richard E. Gluck

[57] ABSTRACT

A portable water pump for use with swimming pools including a flotation collar having a recess formed therein. A circular aperture extends through the collar. The floatation collar is adapted for floating in a body of water. An engine is positionable within the recess of the floatation collar. A water pump is secured and operably coupled with the engine. The water pump has a water inlet and a water outlet. The water inlet has a pipe extending outwardly and downwardly therefrom through the circular aperture of the flotation collar.

7 Claims, 3 Drawing Sheets

FIG 1
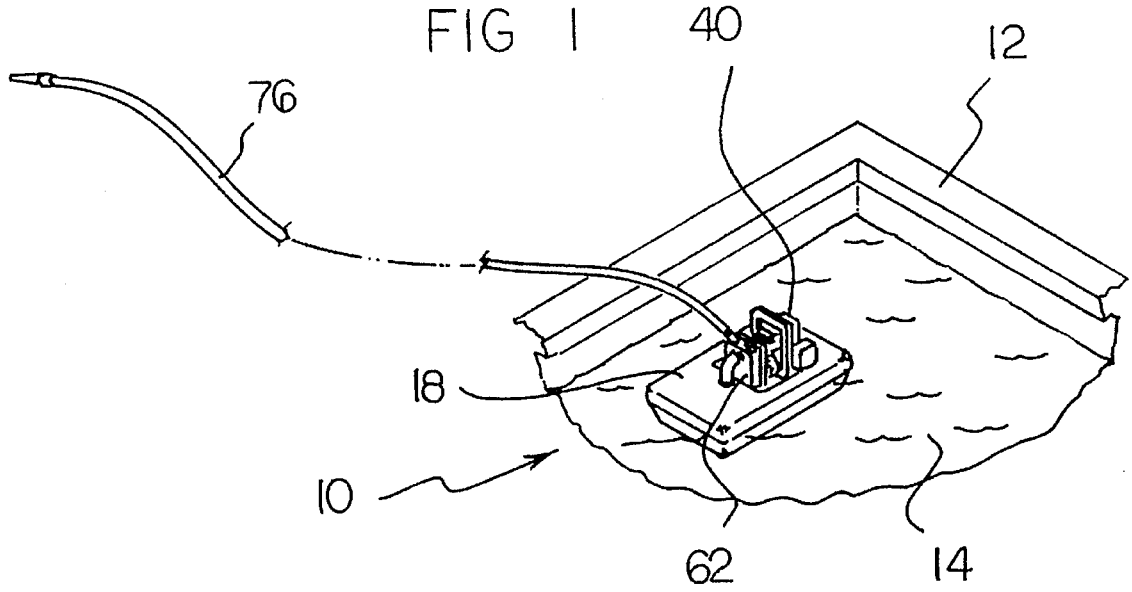
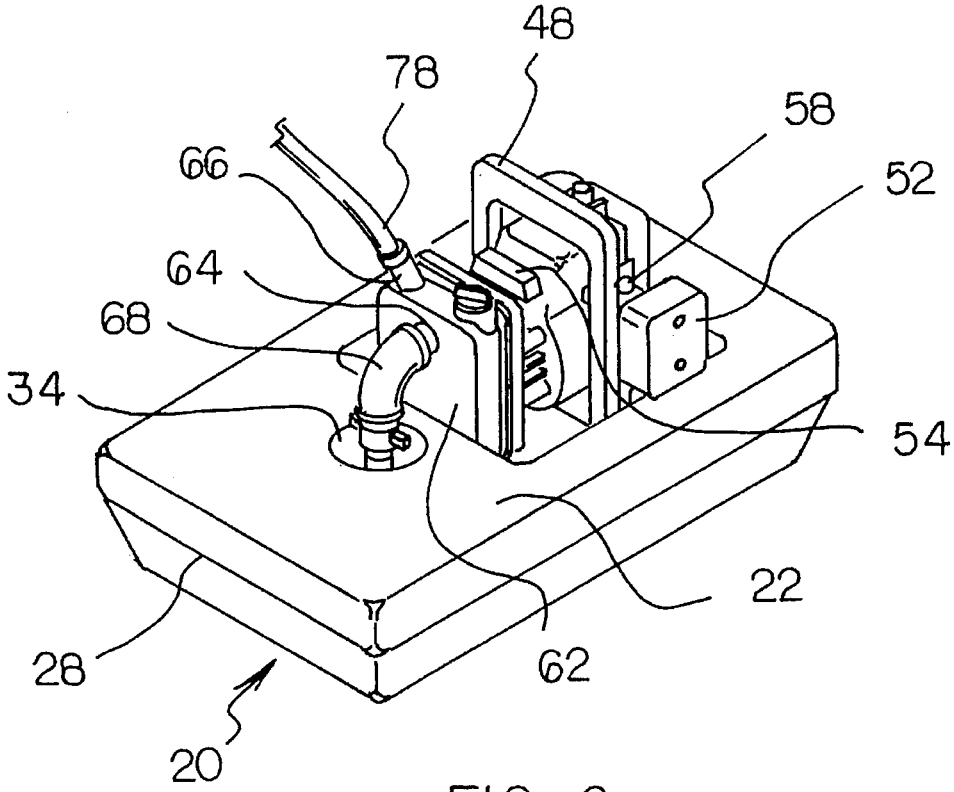
FIG 2

62
4
48
40
68
34
30
26
24
4

32
50
30
42
44
46
24

PORTABLE WATER PUMP FOR USE WITH SWIMMING POOLS

BACKGROUND OF THE INVENTION

1. Field of the Invention

The present invention relates to a portable water pump for use with swimming pools and more particularly pertains to floating in a swimming pool to allow for pool water to be pumped out of the pool for dousing a fire with a portable water pump for use with swimming pools.

2. Description of the Prior Art

The use of floating pumps is known in the prior art. More specifically, floating pumps heretofore devised and utilized for the purpose of having a pump float on water for use therewith are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,553,902 to Eberhardt discloses a floating portable pump.

U.S. Pat. No. 5,125,458 to Berman discloses a fire fighting apparatus.

U.S. Pat. No. 4,089,620 to Ravitts discloses a floating pumping device.

U.S. Pat. No. 5,419,497 to Warrington discloses a portable pumping station.

U.S. Pat. No. 4,789,307 to Sloan discloses a floating pump assembly.

U.S. Pat. No. 3,910,725 to Rule discloses a portable pump apparatus.

While these devices fulfill their respective, particular objective and requirements, the aforementioned patents do not describe a portable water pump for use with swimming pools for floating in a swimming pool to allow for pool water to be pumped out of the pool for dousing a fire.

In this respect, the portable water pump for use with swimming pools according to the present invention substantially departs from the conventional concepts and designs of the prior art, and in doing so provides an apparatus primarily developed for the purpose of floating in a swimming pool to allow for pool water to be pumped out of the pool for dousing a fire.

Therefore, it can be appreciated that there exists a continuing need for new and improved portable water pump for use with swimming pools which can be used for floating in a swimming pool to allow for pool water to be pumped out of the pool for dousing a fire. In this regard, the present invention substantially fulfills this need.

SUMMARY OF THE INVENTION

In the view of the foregoing disadvantages inherent in the known types of floating pumps now present in the prior art, the present invention provides an improved portable water pump for use with swimming pools. As such, the general purpose of the present invention, which will be described subsequently in greater detail, is to provide a new and improved portable water pump for use with swimming pools and method which has all the advantages of the prior art and none of the disadvantages.

To attain this, the present invention essentially comprises a swimming pool having a body of water disposed therein. The system includes a flotation collar comprised of a housing having a generally rectangular configuration. The housing has a planar upper surface, a planar lower surface, two long side surfaces and two short side surfaces. The upper surface has a recess formed therein. The recess has bolts extending upwardly therefrom disposed in four corners thereof. A circular aperture extends from the upper surface outwardly of the lower surface adjacent to the recess. The floatation collar is adapted for floating in the swimming pool. The system includes a gasoline engine having a planar generally rectangular base plate secured to a lower surface thereof. The base plate has apertures therethrough in four corners thereof for receiving the bolts on the recess therethrough for securement of the engine to the floatation collar. A U-shape handle extends over the engine and has free ends secured to the base plate. A water pump is secured and operably coupled with the gasoline engine. The water pump has a water inlet and a water outlet. The water inlet has a pipe extending outwardly and downwardly therefrom through the circular aperture of the housing of the flotation collar. A free end of the pipe has a suction strainer coupled thereto whereby the suction strainer is in contact with the body of water of the swimming pool. A water hose is includes in the system having a first free end that is coupleable to the water outlet of the water pump. A second free end of the water hose has a spray nozzle coupled thereto.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable water pump for use with swimming pools which has all the advantages of the prior art floating pumps and none of the disadvantages.

It is another object of the present invention to provide a new and improved portable water pump for use with swimming pools which may be easily and efficiently manufactured and marketed.

It is a further object of the present invention to provide a new and improved portable water pump for use with swimming pools which is of durable and reliable construction.

An even further object of the present invention is to provide a new and improved portable water pump for use with swimming pools which is susceptible of a low cost of manufacture with regard to both materials and labor, and which accordingly is then susceptible of low prices of sale to the consuming public, thereby making such a portable water pump for use with swimming pools economically available to the buying public.

Still yet another object of the present invention is to provide a new and improved portable water pump for use with swimming pools which provides in the apparatuses and methods of the prior art some of the advantages thereof, while simultaneously overcoming some of the disadvantages normally associated therewith.

Even still another object of the present invention is to provide a new and improved portable water pump for use with swimming pools for floating in a swimming pool to allow for pool water to be pumped out of the pool for dousing a fire.

Lastly, it is an object of the present invention to provide a new and improved portable water pump for use with swimming pools including a flotation collar having a recess formed therein. A circular aperture extends through the collar. The floatation collar is adapted for floating in a body of water. An engine is positionable within the recess of the floatation collar. A water pump is secured and operably coupled with the engine. The water pump has a water inlet and a water outlet. The water inlet has a pipe extending outwardly and downwardly therefrom through the circular aperture of the flotation collar.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the present invention illustrated in a swimming pool.

FIG. 2 is a perspective view of the preferred embodiment of the portable water pump for use with swimming pools constructed in accordance with the principles of the present invention.

The same reference numerals refer to the same parts through the various Figures.

DESCRIPTION OF THE PREFERRED EMBODIMENT

Figure 3:
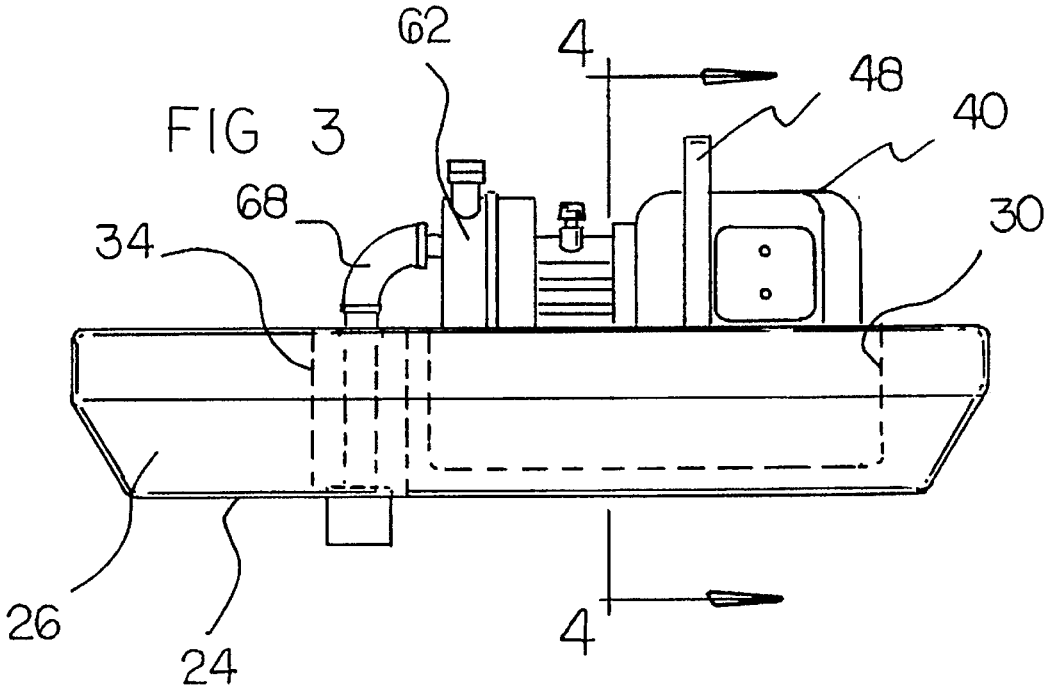
FIG. 3 is a side elevation view of the present invention.
Figure 4:
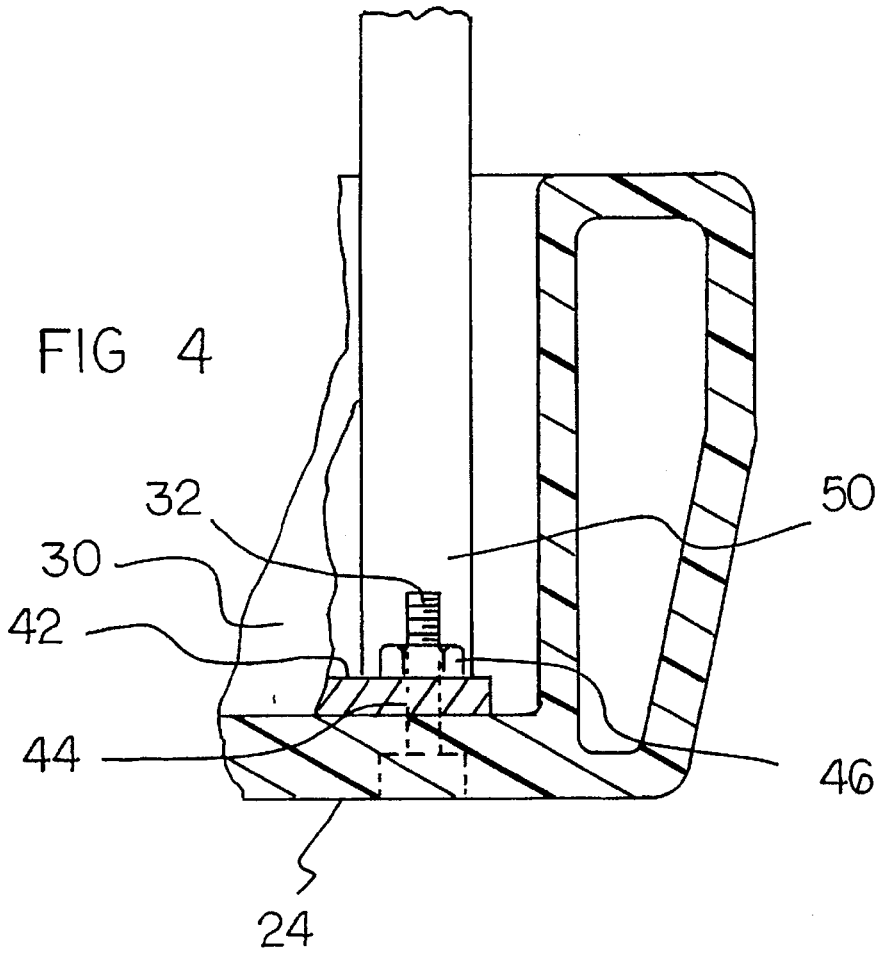
FIG. 4 is a cross-sectional view as taken along line 4—4 of FIG. 3.
Figure 5:
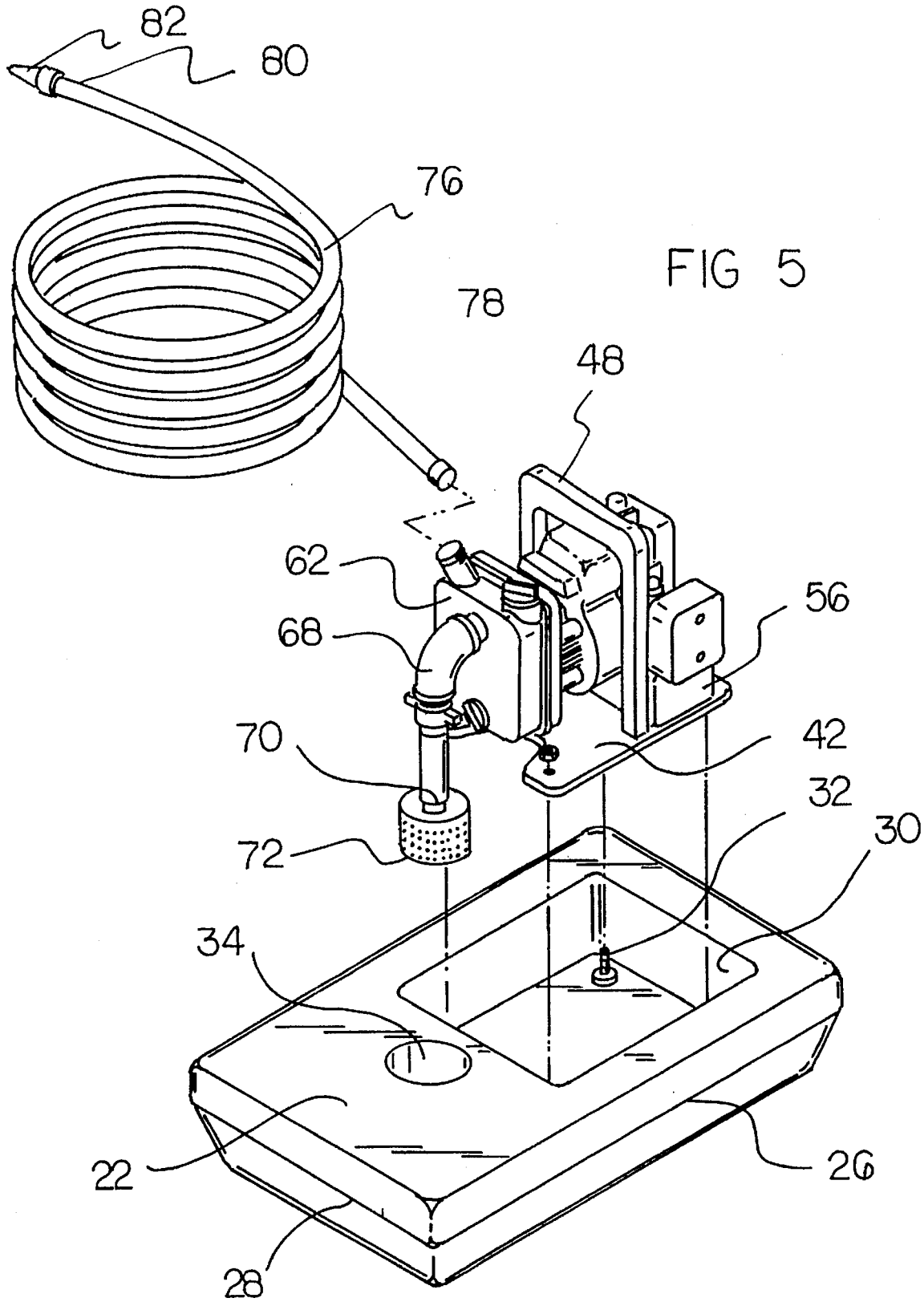
FIG. 5 is an exploded perspective view of the present invention.

With reference now to the drawings, and in particular, to FIGS. 1–5 thereof, the preferred embodiment of the new and improved portable water pump for use with swimming pools embodying the principles and concepts of the present invention and generally designated by the reference number 10 will be described.

Specifically, it will be noted in the various Figures that the device relates to a portable water pump for use with swimming pools for floating in a swimming pool to allow for pool water to be pumped out of the pool for dousing a fire. In its broadest context, the device consists of a swimming pool, a floatation collar, a gasoline engine, a water pump and a water hose. Such components are individually configured and correlated with respect to each other so as to attain the desired objective.

The system 10 includes a swimming pool 12 having a body of water 14 disposed therein. An alternate source of water could also be implemented within the system 10, such as a pond or small lake, which are adjacent to usage area of the system 10. The system 10 in use in the swimming pool 12 is illustrated in FIG. 1.

The system 10 includes a flotation collar 18 comprised of a housing 20 having a generally rectangular configuration. The housing 20 has a planar upper surface 22, a planar lower surface 24, two long side surfaces 26 and two short side surfaces 28. The upper surface 22 has a recess 30 formed therein. The recess 30 has a length of about half of a length of the housing 20 and a width more than half of a width of the housing 20. The recess 30 has bolts 32 extending upwardly therefrom disposed in four corners thereof. A circular aperture 34 extends from the upper surface 22 outwardly of the lower surface 24 adjacent to the recess 30. The floatation collar 18 is adapted for floating in the swimming pool 12. The floatation collar 18 is preferably constructed of a molded plastic with a preferably filling of polyethylene to allow for the system 10 to float of the body of water 14.

The system 10 also includes a gasoline engine 40 having a planar generally rectangular base plate 42 secured to a lower surface thereof. The base plate 42 has apertures 44 therethrough in four corners thereof for receiving the bolts 32 on the recess 30 therethrough for securement of the engine 40 to the floatation collar 18. The alignment of the apertures 44 with the bolts 32 allows the engine 40 to be positioned within the recess 30. Four nuts 46 used to secure the engine 40 in place. A U-shape handle 48 extends over the engine 40 and has free ends 50 secured to the base plate 42. The U-shaped handle 48 allows for the engine 40 to be easily removed from, or placed within, the recess 30. The engine 40 is of the standard gasoline engine used in the art. The engine 40 includes an air filter 52, a pull start cord 54, a fuel tank 56, a primer diaphragm 58.

A water pump 62 is secured and operably coupled with the gasoline engine 40. The water pump 62 has a water inlet 64 and a water outlet 66. The water inlet 64 has a pipe 68 extending outwardly and downwardly therefrom through the circular aperture 34 of the housing 20 of the flotation collar 18. A free end 70 of the pipe 64 has a suction strainer 72 coupled thereto whereby the suction strainer 72 is in contact with the body of water 14 of the swimming pool 12. Once the engine 40 is activated, the water pump 62 will suction water from the swimming pool 12 through the water inlet 64 and out through the water outlet 66.

Lastly, a water hose 76 is included in the system 10 having a first free end 78 that is coupleable to the water outlet 66 of the water pump 62. A second free end 80 of the water hose 76 has a spray nozzle 82 coupled thereto. The water hose 76 receives the water from the water pump 62 to be distributed onto a burning house or the like.

The system 10 is a portable, floating fire pump designed specifically for use in home owners swimming pools. The system 10 pumps up to eighty gallons per hour reaching rooftop height of two story buildings. The system weighs just twenty-four pounds and can be handled and operated by one person easily.

The water pump 62 has lightweight corrosion resistant aluminum alloy body built directly onto the engine 40. The system 10 includes a compact polyethylene floatation collar 18 and a handle and splash suppression collar for engine 40 protection when in water. The system 10 also includes injection molded plastic pump housing and impeller as well as mechanical seals.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A portable water pump for use with swimming pools for floating in a swimming pool to allow for pool water to be pumped out of the pool for dousing a fire comprising, in combination:

a swimming pool having a body of water disposed therein;

a flotation collar comprised of a housing having a generally rectangular configuration, the housing having a planar upper surface, a planar lower surface, two long side surfaces and two short side surfaces, the upper surface having a recess formed therein, the recess having bolts extending upwardly therefrom disposed in four corners thereof, a circular aperture extends from the upper surface outwardly of the lower surface adjacent to the recess, the floatation collar adapted for floating in the swimming pool;

a gasoline engine having a planar generally rectangular base plate secured to a lower surface thereof, the base plate having apertures therethrough in four corners thereof for receiving the bolts on the recess therethrough for securement of the engine to the floatation collar, a U-shape handle extends over the engine and having free ends secured to the base plate;

a water pump secured and operably coupled with the gasoline engine, the water pump having a water inlet and a water outlet, the water inlet having a pipe extending outwardly and downwardly therefrom through the circular aperture of the housing of the flotation collar, a free end of the pipe having a suction strainer coupled thereto whereby the suction strainer in contact with the body of water of the swimming pool; and a water hose having a first free end coupleable to the water outlet of the water pump, a second free end of the water hose having a spray nozzle coupled thereto.

2. A portable water pump comprising:

a flotation collar having a recess formed therein, a circular aperture extends through the collar, the floatation collar adapted for floating in a body of water;

an engine positionable within the recess of the floatation collar, the engine having a planar generally rectangular base plate secured to a lower surface thereof, the base plate having apertures therethrough in four corners thereof for receiving four bolts positioned in the recess therethrough for securement of the engine to the floatation collar;

a water pump secured and operably coupled with the engine, the water pump having a water inlet and a water outlet, the water inlet having a pipe extending outwardly and downwardly therefrom through the circular aperture of the flotation collar.

3. The portable water pump as set forth in claim 2 wherein the flotation collar comprised of a housing having a generally rectangular configuration, the housing having a planar upper surface, a planar lower surface, two long side surfaces and two short side surfaces, the upper surface having the recess formed therein.

4. The portable water pump as set forth in claim 2 and further including a U-shape handle extends over the engine and having free ends secured to the base plate.

5. The portable water pump as set forth in claim 2 wherein a free end of the pipe having a suction strainer coupled thereto whereby the suction strainer in contact with a body of water.

6. The portable water pump as set forth in claim 2 and further including a water hose having a first free end coupleable to the water outlet of the water pump, a second free end of the water hose having a spray nozzle coupled thereto.

7. The portable water pump as set forth in claim 2 wherein the engine is gasoline powered.

* * * * *